United States Patent [19]

Jeff

[11] 4,100,677

[45] Jul. 18, 1978

[54] PRECISION CUTTING TOOL

[76] Inventor: Adolph L. Jeff, 155 Park La., Rochester, N.Y. 14625

[21] Appl. No.: 768,726

[22] Filed: Feb. 15, 1977

[51] Int. Cl.[2] ..... B26B 1/00

[52] U.S. Cl. ..... 30/321; 30/339

[58] Field of Search ..... 30/161, 156, 157, 321, 30/330, 331, 339, 171

[56] References Cited

U.S. PATENT DOCUMENTS

| | | | |
|---|---|---|---|
| 1,140,020 | 5/1915 | Bradley | 30/171 X |
| 3,518,758 | 7/1970 | Bennett | 30/321 X |
| 3,851,986 | 12/1974 | Daughtry | 30/156X |

*Primary Examiner*—Jimmy C. Peters

*Attorney, Agent, or Firm*—Warren W. Kurz

[57] ABSTRACT

An improved cutting tool of the type used by graphic artists and designers is provided. The tool comprises an elongated handle, a cutting blade, and means for detachably clamping the blade to the handle to dispose the cutting edge of the blade at one of a plurality of desired angular positions relative to the handle.

3 Claims, 9 Drawing Figures

PRECISION CUTTING TOOL

CROSS REFERENCE TO RELATED APPLICATIONS

Reference is hereby made to my related U.S. patent application, Ser. No. 768,727 now U.S. Pat. No. 4,077,555 filed on Feb. 15, 1977, entitled BLADE BREAKING APPARATUS.

BACKGROUND OF THE INVENTION

This invention relates to improvements in precision cutting tools of the type commonly used by graphic artists and designers. More particularly, it relates to a cutting tool having an elongated handle which releasably engages the tang portion of a cutting blade to dispose the cutting edge thereof at selected angular positions relative to the handle.

To create or reproduce a desired design or symbol, graphic artists often find it necessary to make very delicate and precise cuts in a sheet of plastic, paper or the like. To achieve these cuts, many artists resort to the common single-edge industrial razor blade. Such a simple cutting tool is usually preferred over more sophisticated cutting knifes, such as, for instance, disclosed in U.S. Pat. Nos. 3,683,498 and 3,802,077, because of the advantages it offers. For example, the cutting edge of an industrial blade is far superior to that of the blades typically provided with these cutting knifes. Usually, the cutting blades of these knifes are fabricated from a relatively heavy guage steel so that it can be repeatedly resharpened, albeit never to the quality of the cutting edge of a fresh razor blade. Another advantage of the industrial razor blade is that it has two cutting points, disposed at opposite ends of the cutting edge. The blades of the aforementioned knifes, on the other hand, have only one cutting point and, when this point becomes blunted through use, the useful lifetime of the blade for delicate cutting is ended. Still another very significant advantage of the industrial razor blade is that an artist can, by adjusting the position of the blade in his finger tips, adjust the angle of the cutting edge relative to the work surface. Very precise cutting is often facilitated by disposing the cutting edge at various acute angles of less than 30° relative to the work surface. Such positioning of the cutting edge allows the artist to follow more accurately the position of the cutting point of the blade, and also reduces the pressure necessary to effect the cut by bringing more of the cutting edge of the blade into contact with the material being cut. In contrast, the aforementioned cutting knifes comprise an elongated handle which is adapted to be held in an upright position, much like a pencil, and, since the blade portion of these knifes is fixed relative to the handle such that the cutting edge is parallel to, or forms an acute angle with, the longitudinal axis of the handle, it is very difficult for the artist to dispose the cutting edge at an angle of less than 30° relative to the work surface while still maintaining accurate control over the position of the cutting point.

While the industrial single edge razor blade appears to satisfy most of the cutting needs of graphic artists and designers, it is, owing to its size and shape, an inherently dangerous cutting instrument. Once positioned on a flat surface, it is difficult to pick up, and nicks and small cuts are all too often the result in attempting to do so. Also, because the holding edge, i.e. the non-cutting edge, is positioned so close to the cutting edge, there is a chance the user will receive a more serious cut if the blade should snap during the cutting operation, or if the user is not totally careful in manipulating the blade. While the cutting knifes of the type mentioned above are substantially less dangerous to handle, they do not offer the aforementioned advantages of the industrial razor blade.

SUMMARY OF THE INVENTION

It is, therefore, an object of the present invention to provide a precision cutting tool of the type which would be particularly useful to graphic artists and designers and which combines the respective advantages of the aforementioned industrial razor blade and other cutting tools without suffering the respective disadvantages.

Toward this end there is provided in accordance with the present invention a precision cutting tool which comprises an elongated handle, a cutting blade having a tang portion spaced from its cutting edge, and means for detachably clamping the tang portion to one end of the handle to dispose the cutting edge at one of a plurality of desired angular positions relative to the handle. The clamping means comprises a shaft mounted on one end of the handle for supporting the blade at a plurality of angular positions relative to the handle, and locking means for selectively preventing movement of the blade about its supporting shaft in at least one direction; i.e. the direction in which force is exerted on the blade during usage. Preferably, the blade comprises a portion of a common industrial razor blade, so that the cutting point can be repeatedly refreshened by snapping off a small piece of the blade along a line transverse to the cutting edge.

An advantage of the cutting tool of the invention is that the cutting edge of the blade portion of the tool can be maintained at very low cutting angles relative to the work surface while the handle can be held in a relatively upright position relative to such work surface. This feature facilitates extremely precise and delicate cutting.

Other objects and advantages of the invention will become more apparent to those skilled in the art from the ensuing detailed description of preferred embodiments, references being made to the accompanying drawings.

DETAILED DESCRIPTION OF PREFERRED EMBODIMENTS

Figures 1, 2, 3, 4:
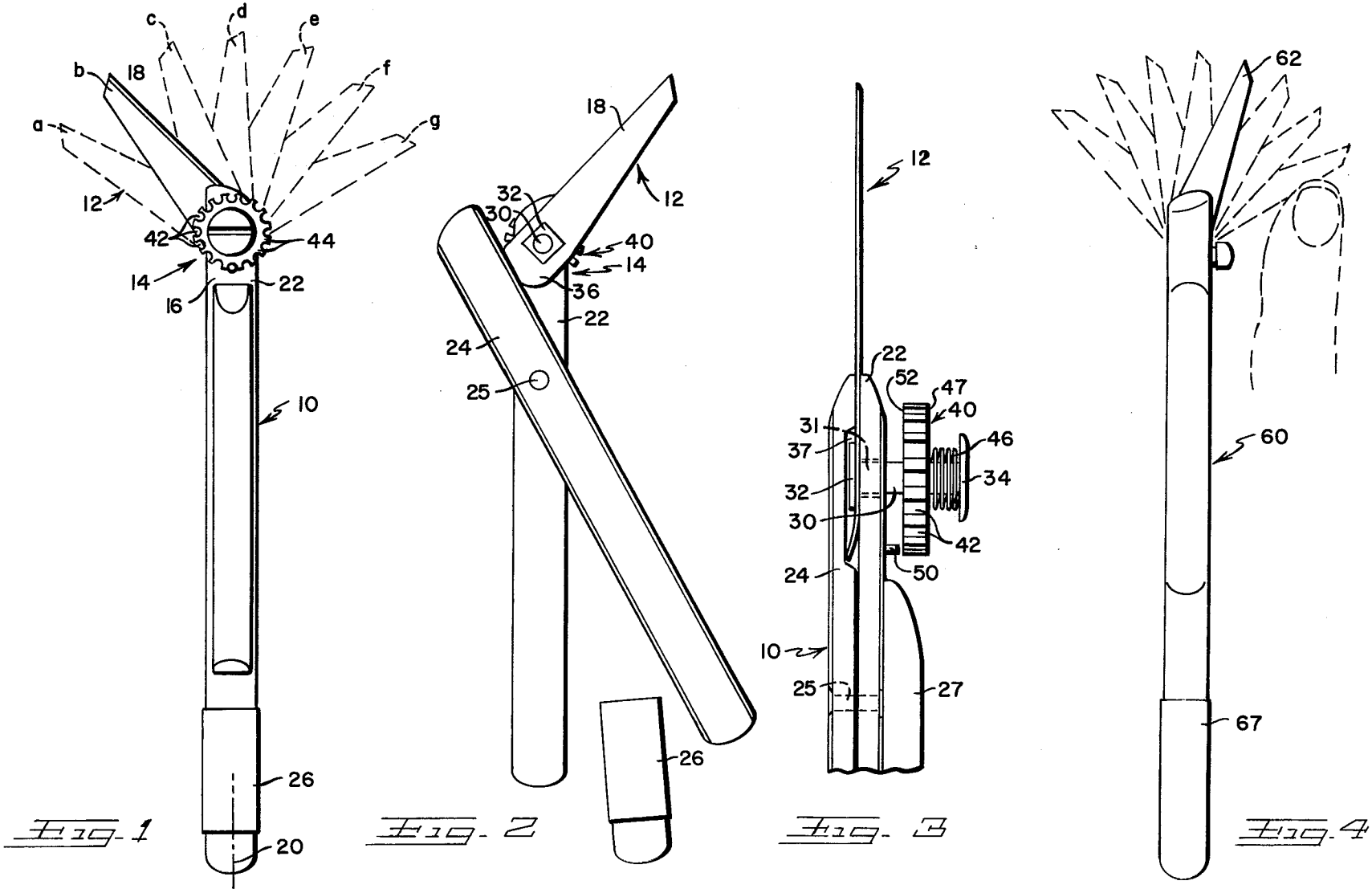
FIGS. 1 and 2 are front and rear elevational views of a cutting tool structured in accordance with a preferred embodiment of the invention.
FIG. 3 is an enlarged side elevational view of a portion of the tool depicted in FIGS. 1 and 2.
FIGS. 4 and 5 are side elevational views of an alternate embodiment of the invention, showing the tool handle in blade-clamping and blade-releasing positions, respectively.

Referring now to the drawings, a precision cutting tool structured in accordance with a preferred embodiment of the invention is depicted in FIGS. 1–3. As shown, the tool basically comprises an elongated handle 10, a cutting blade 12 and clamp means 14 for clamping the blade to one end 16 of the handle so that the cutting edge 18 of the blade is positioned in one of a plurality of angular positions (shown in phantom lines in FIG. 1) relative to the longitudinal axis 20 of the handle. Handle 10, as best shown in FIG. 2, comprises two elongated members 22, 24, each having a substantially rectilinear transverse cross-section. Handle members 22, 24 are pivotally connected by a pin 25 which allows the handle members to move relative to each other in a scissors-like action. When the handle members are pivoted apart, as shown in FIG. 2, blade 12 may be removed and replaced. In use, the handle members are pivoted together, as shown in FIG. 1, and a cap 26 which can be slid over the ends of the handle members normally prevents the members from pivoting apart. A rounded finger gripping member 27 can be mounted on the exterior surface 28 of one or both handle member 22, 24 to facilitate gripping of the tool by the user.

As in all of the embodiments described hereinbelow, the cutting blade preferably comprises carbon-steel having a thickness from 5–15 mils. Blades which have found particularly useful are those fabricated from the blade portion of the common industrial, single-edge razor blade, manufactured by American Safety Razor Co., in New York, New York, or from the blade portion of the conventional single-edge injector blade, manufactured by Schick Safety Razor Company, a division of Warner Lamberts, Milford, Connecticut. Owing to its relatively thin guage and brittleness, an industrial single edge razor blade can be modified, by a "breaking" technique, (described in my copending U.S. application Ser. No. 768,727, filed on Feb. 15, 1977 now U.S. Pat. No. 4,077,555) to produce the configuration of blade 12 shown in FIGS. 1 and 2.

As indicated above, blade 12 can be clamped to the end of handle 10 in a variety of angular positions, including those shown in phantom lines in FIG. 1. This feature allows the user, such as a graphic artist, to readily adjust the angular position of the blade relative to the work surface to achieve a desired "comfort angle" while still allowing the handle portion of the tool to be held in a substantially upright position (i.e. substantially perpendicular to the cutting surface).

Clamp means 14 comprises a shaft 30 which is mounted for rotation in an aperture 31 formed in one end of handle member 22. A rectangularly shaped lug 32 is formed on one end of shaft 30, and circular cap 34 is formed on the opposite end. Lug 32 mates with a rectangular aperture 33 formed in the tang portion 36 of blade 12; thus, the angular position of the blade relative to the handle is determined by the angular position of shaft 30. A recess 37 is formed in handle member 24 to provide room for lug 32. See FIG. 3.

To lock the position of the blade relative to the handle, and thereby prevent movement of the blade relative to the handle when pressure is applied to the cutting edge, a multifaceted disc 40 is slidably mounted on shaft 30 for axial movement therealong. Disc 40 is keyed to rotate with shaft 30 and comprises means defining a plurality of equally spaced concave facets 42 around the periphery of the disc, such facets being spaced apart by flat flutes 44. A compression spring 46 surrounds shaft 30 between cap 34 and the outer surface 46 of disc 40, and acts to spring bias disc 40 toward engagement with the outer surface 28 of handle member 22. A fixed pin 50 extends outwardly from the outer surface 28 of handle member 22 at a position to engage one of the facets 42 of disc 40 when disc 40 engages surface 28. When disc 40 is so positioned, pin 50 prevents rotational movement of shaft 30 and, hence, any change in the angular position of blade 12. Axial movement of the blade on shaft 30 is prevented by the end of handle member 22, when the handles are pivoted together as shown in FIG. 1.

To adjust the angular position of blade 12, disc 40 is manually slid along shaft 30 against the bias of compression spring 46 until the inner surface 52 of disc 40 clears the top of pin 50. (See FIG. 3.) At this point, disc 40 can be rotated to change the angular position of blade 12. The angular position of blade 12 can be locked at any position in which one of the vacets 42 is aligned with pin 50. Upon releasing disc 40, it reseats itself with pin 50 in engagement with one of facets 42.

As is evident from the variety of cutting positions of blade 12 illustrated in the phantom lines in FIG. 1, the cutting tool of the invention can be adapted to perform a variety of cutting functions. When the blade is positioned in position a, the user may readily achieve a very low cutting angle (e.g. less than 5°) relative to a planar work surface while still holding the handle in a comfortable upright position. If the particular cutting job requires that substantial pressure be applied to the cutting edge, positions *b, c* or *d* might be more appropriate. The blade can be set to achieve virtually any desired comfort angle. To cut a particularly tough material, blade positions *e, f* and *g* might be more appropriate. The number of angular positions at which the blde can be locked, of course, depends on the number of facets formed in the periphery of disc 40. As indicated above, the cutting blade may be removed by merely removing cap 26, pivoting the handle members 22, 24 apart, as shown in FIG. 2, and lifting the blade off of rectangular lug 32.

Figure 5:
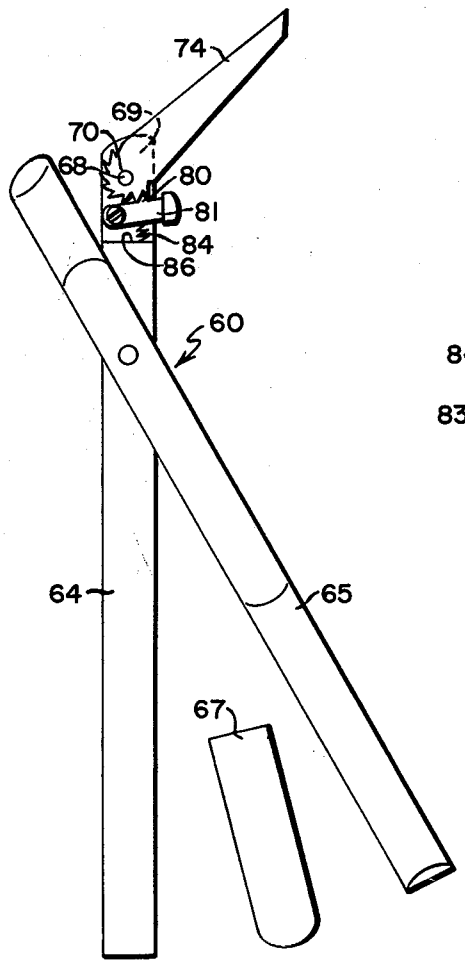

Referring now to FIGS. 4 and 5, a variation of the aforedescribed cutting tool of the invention is shown to comprise an elongated handle 60, a cutting blade 62, means for pivotally mounting the blade on one end of the handle, and ratchet means for preventing pivotal movement of the blade relative to the handle in one direction to lock the blade position, during usage, in one of a plurality of angular positions, while enabling pivotal movement in the opposite direction. Handle 60 is similar in construction to the aforedescribed handle 10, comprising two handle members 64, 65 which are pivotally connected by a pin 66. A cap 67 normally prevents pivotal movement between the handle members. Blade 62 is pivotally mounted at one end of handle member 64 on a pin 68 which extends outwardly from the interior surface 69 of such handle member. Pin 66 engages a circular aperture 70 formed in the tang portion 72 of blade 62.

To prevent blade 62 from pivoting clockwise, as viewed in FIG. 4, about the end of handle 60 in response to a force exerted against the cutting edge 74, as would occur during usage, a ratchet 76 is formed in the circular edge 77 of the tang portion 72 of the blade. The teeth of ratchet 76 are engaged by a pawl 80 extending from one edge of a lever 82 which is pivotally mounted on handle member 64 by a pin 82. A compression spring 84, positioned between the bottom edge of lever 82 and a step surface 86 form on handle member 64, acts to urge lever 82 to move in a clockwise direction about pin 82, thereby urging pawl 80 into engagement with the teeth of ratchet 76.

In use, the angular position of blade 62 relative to handle 60 can be adjusted to a desired position by merely pivoting the blade counter-clockwise, as viewed in FIG. 4. Ratchet 76, due to the pitch of the teeth thereof, will allow such movement, but not movement in the opposite direction. When it becomes necessary or desirable to move the blade clockwise, the end 87 of lever 82 is manually pulled backward, against the force provided by spring 84, so as to disengage pawl 80 from the teeth of ratchet 76. Blade 62 can then be pivoted clockwise to a desired position.

Figure 7:
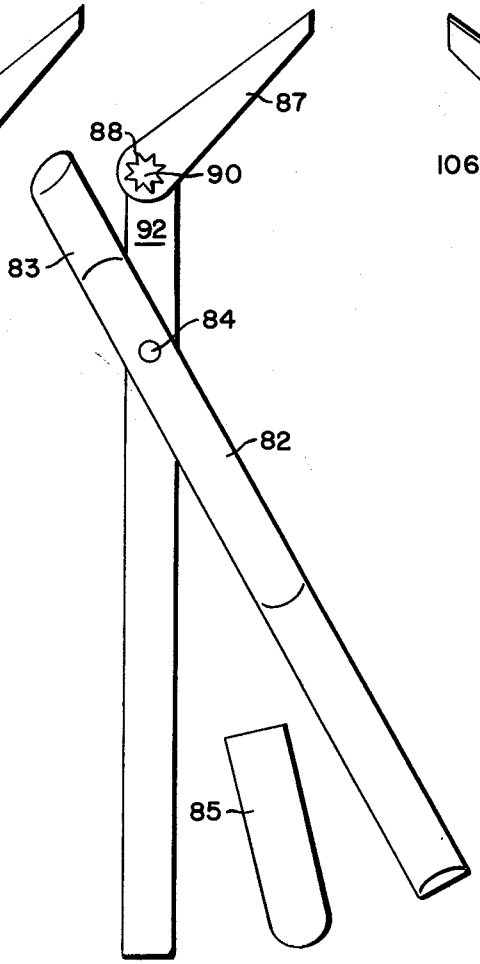
FIGS. 6 and 7 are side elevational views of a further embodiment of the invention, showing the handle in blade-clamping and blade-releasing positions, respectively.
Figure 6:
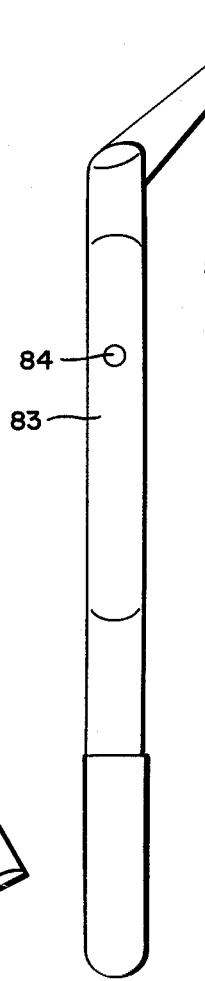

Another embodiment of the invention is depicted in FIGS. 6 and 7. As in the aforedescribed embodiments, the handle 80 is comprised of a pair of handle members 82, 83 which are pivotally connected by a pin 84, and a cap 85 or the like can be used to maintain the handle members together as shown in FIG. 6, in a blade clamping position. The blade 87 is provided with a multifaceted or polygonally shaped aperture 88 which mates with a similarly shaped lug 90 which is rigidly mounted on the interior surface 92 of handle member 82. The angular position of the blade relative to the handle can be adjusted by pivoting the handle member apart, as shown in FIG. 7, and removing and reseating blade 87 on lug 90. The more facets or faces on lug 90, of course, the greater number of angular positions for blade 87.

Figure 9:
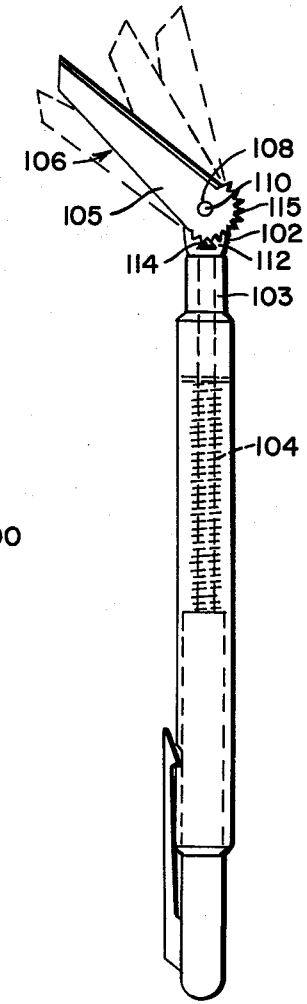
FIGS. 8 and 9 are side elevational views of still another embodiment of the invention, showing the handle in blade-clamping and blade-releasing positions, respectively.
Figure 8:
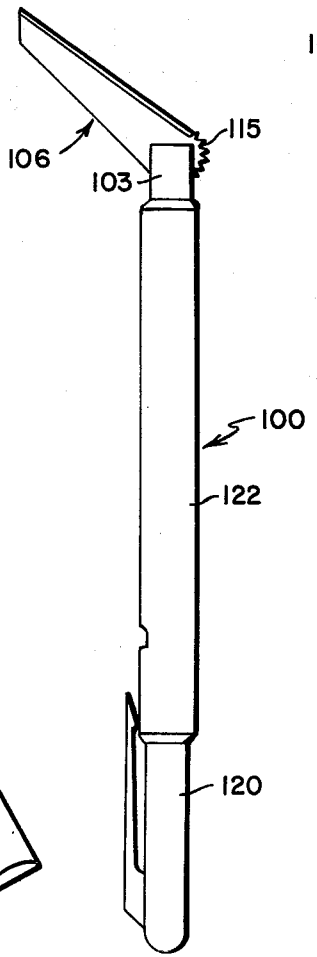

Still another version of the cutting tool of the invention is illustrated in FIGS. 8 and 9. In this embodiment, the handle 100 comprises two handle members 102, 103 which, rather than being pivotally mounted, as in the aforedescribed embodiments, to provide for access to the blade mount, are slidably mounted for relative axial movement within a cylindrical sleeve 105. A spring 104 acts to bias the handle members toward alignment, in a blade gripping position, as shown in FIG. 8. Exerting axial pressure on handle member 102 via plunger 106 which is rigidly coupled therewith acts to separate the handle members to expose the interior surface of member 102 at the end at which blade 106 is mounted. As shown in FIG. 9, the tang 105 of blade 106 is provided with a circular aperture 108 which engages a pin 110 extending outwardly from the interior surface 112 of handle member 102. By this arrangement, blade 106 is pivotally mounted on the end of handle member 102. To lock the position of the blade relative to the handle, a pawl 114 is rigidly mounted on the interior surface 112 of handle 102 at a position to engage one of the teeth of a circular rack 115 formed in the periphery of the blade tang 105. To adjust the angular position of the blade, the blade is slid outwardly along pin 110 until rack 115 becomes disengaged from pawl 114. The blade is then pivoted to the desired position and reseated on pin 110 with pawl 114 engaging another one of the teeth of rack 115. Note, rack 115 could be modified to have a ratchet configuration, in which case, pivotal movement of the blade would only be resisted in the direction in which the blade would pivot in response to pressure applied to the cutting edge 120.

While the invention has been described with particular referene to certain preferred embodiments, it is not intended to be limited to the details shown, inasmuch as various modifications and structural changes will be self-evident to those skilled in the art without departing from the spirit and scope of the invention as defined by the appended claims. For instance, rather than forming a rack or ratchet on the edge of the tang portion of the blade, which, when engaged by a pawl on the handle, locks the blade position, one surface of the tang could be roughened or scored to mate with a similarly scored interior surface of one of the handle members to achieve the same purpose.

I claim:

1. A precision cutting instrument of the type adapted for use by graphic artists, said cutting instrument comprising: an elongated handle having a longitudinal axis extending along the length thereof; a planar cutting blade having a cutting edge and a tang portion spaced therefrom; and clamping means mounted on one end of said handle for detachably clamping the tang portion of the blade to said one end of the handle to position said blade in one of a plurality of predetermined angular positions relative to said axis, said clamping means comprising: (a) a shaft for supporting said blade on said one end of the handle; (b) means for rotatably mounting said shaft on said one end of the handle; (c) means for keying said blade to said shaft so as to rotate therewith, whereby the angular position of said blade relative to said axis is governed by the angular position of said shaft; and (d) locking means for selectively preventing rotational movement of said shaft in at least one direction while said blade is positioned in one of said plurality off predetermined angular positions, said locking means comprising: (i) a disc-member having a plurality of spaced indentations formed in the periphery thereof, said disc being journalled to rotate with said shaft and being slidably mounted on said shaft for axial movement between first and second spaced positions; (ii) a pin member rigidly mounted on said one end of the handle and extending outwardly therefrom to engage one of said indentations while said disc is in said first position, and thereby prevent rotational movement of said shaft, said pin member being of a length shorter than the spacing between said first and second positions, whereby said pin member disengages said indentation upon movement of said disc to said second position, and thereby allows said shaft to rotate; and (iii) means for urging said disc into said first position.

2. The precision cutting instrument as defined by claim 1 wherein said urging means comprises a spring.

3. The precision cutting instrument defined by claim 1 wherein said cutting blade comprises a carbon steel material having a thickness between 5 and 15 mils.

* * * * *